US007828702B2

(12) United States Patent
Lien et al.

(10) Patent No.: US 7,828,702 B2
(45) Date of Patent: Nov. 9, 2010

(54) WEIGHT PLATE

(75) Inventors: Louis Lien, Bellaire, TX (US); Katy Phan, Tomball, TX (US)

(73) Assignee: USA Sports, Inc., Houston, TX (US)

( * ) Notice: Subject to any disclaimer, the term of this patent is extended or adjusted under 35 U.S.C. 154(b) by 466 days.

(21) Appl. No.: 10/938,062

(22) Filed: Sep. 10, 2004

(65) Prior Publication Data

US 2007/0135271 A1 Jun. 14, 2007

(51) Int. Cl.
*A63B 21/072* (2006.01)
*A63B 21/075* (2006.01)
*A63B 21/06* (2006.01)

(52) U.S. Cl. ..... 482/106; 482/93

(58) Field of Classification Search ..... 482/93, 482/105–109; D21/680–682; *A63B 21/06, A63B 21/072, 21/075*
See application file for complete search history.

(56) References Cited

U.S. PATENT DOCUMENTS

| | | | |
|---|---|---|---|
| 1,047,212 | A | 12/1912 | Hamilton |
| 1,366,200 | A | 1/1921 | Matysek |
| 2,244,351 | A | 6/1941 | Venables |
| 2,447,218 | A | 8/1948 | Trzesniewski |
| 2,676,802 | A | 4/1954 | O'Brien |
| 2,796,269 | A | 6/1957 | Watson |
| D194,042 | S | 11/1962 | Guthormsen |
| 3,171,652 | A | 3/1965 | Newman |
| 3,226,117 | A | 12/1965 | Walklet |
| 3,482,835 | A | 12/1969 | Dean |
| D216,517 | S | 1/1970 | Dorn |
| 3,572,702 | A | 3/1971 | Dorn |
| 3,771,785 | A | 11/1973 | Speyer |
| 3,796,431 | A | 3/1974 | Sinyard |
| 3,913,908 | A | 10/1975 | Speyer |
| 3,971,555 | A | 7/1976 | Mahnke |
| 4,079,932 | A | 3/1978 | Schuetz |
| 4,231,569 | A | 11/1980 | Rae |
| 4,311,306 | A | 1/1982 | Solloway |
| 4,369,968 | A | 1/1983 | Price |
| 4,373,717 | A | 2/1983 | Lambert, Jr. |
| D274,283 | S | 6/1984 | Wright |
| 4,455,020 | A | 6/1984 | Schnell |
| 4,482,151 | A | 11/1984 | Zwilling |
| D278,358 | S | 4/1985 | Zwilling |

(Continued)

OTHER PUBLICATIONS

USA Sports, Inc., "VTX Grip Plate Casting Details," dated Jun. 12, 2001, 2-pages.

(Continued)

*Primary Examiner*—Loan Thanh
*Assistant Examiner*—Oren Ginsberg
(74) *Attorney, Agent, or Firm*—Wong, Cabello, Lutsch, Rutherford & Brucculeri LLP

(57) ABSTRACT

A weight plate have integrally formed handles is provided. The weight plate has a weight plate body having an outer periphery, a first side, and a second side that is substantially flat. The weight plate also has a central bore extending through the body, a raised flange member forming a portion of the outer periphery on the first side, and at least one handle opening extending through the body and through ht least a portion of the outer periphery. The handle formed by each handle opening, the corresponding recess, and the raised flange member is sufficient for a human hand to grip.

26 Claims, 2 Drawing Sheets

U.S. PATENT DOCUMENTS

| | | | | |
|---|---|---|---|---|
| 4,515,364 | A | 5/1985 | Rotella | |
| 4,625,959 | A | 12/1986 | Schleffendorf | |
| 4,673,179 | A | 6/1987 | Pengler | |
| 4,756,526 | A | 7/1988 | Broussard | |
| 4,817,944 | A | 4/1989 | Anderson et al. | |
| 4,828,256 | A | 5/1989 | Lee | |
| 4,854,575 | A | 8/1989 | Wilson et al. | |
| 4,880,229 | A | 11/1989 | Broussard | |
| D309,763 | S | 8/1990 | Solloway | |
| 4,997,184 | A | 3/1991 | Sherman | |
| 5,137,502 | A | 8/1992 | Anastasi | |
| 5,344,375 | A | 9/1994 | Cooper | |
| D355,007 | S | 1/1995 | Rojas et al. | |
| 5,407,413 | A | 4/1995 | Kupferman | |
| 5,464,379 | A | 11/1995 | Zarecky | |
| 5,509,877 | A | 4/1996 | Adams | |
| 5,573,484 | A | 11/1996 | Carpenter | |
| D377,202 | S | 1/1997 | Rohan | |
| 5,735,777 | A | 4/1998 | Benoit et al. | |
| D394,685 | S | 5/1998 | Eckmann | |
| 5,853,355 | A | 12/1998 | Standish | |
| D405,484 | S | 2/1999 | Rojas et al. | |
| D406,183 | S | 2/1999 | Zovich | |
| D409,266 | S | 5/1999 | Rojas et al. | |
| D421,076 | S | 2/2000 | Lincir | |
| D424,639 | S | 5/2000 | Rojas et al. | |
| D428,947 | S | 8/2000 | Harms et al. | |
| D433,720 | S * | 11/2000 | Rojas et al. | D21/681 |
| D433,721 | S | 11/2000 | Rojas et al. | |
| D434,090 | S | 11/2000 | Wallace et al. | |
| D445,854 | S | 7/2001 | Harms et al. | |
| D448,055 | S | 9/2001 | Lien et al. | |
| D450,361 | S | 11/2001 | Harms et al. | |
| 6,319,176 | B1 | 11/2001 | Landfair | |
| 6,328,678 | B1 | 12/2001 | Romero | |
| 6,436,015 | B1 | 8/2002 | Frasco et al. | |
| 6,736,765 | B2 * | 5/2004 | Wallace et al. | 482/106 |
| 6,746,380 | B2 | 6/2004 | Lien et al. | |
| 6,837,833 | B2 | 1/2005 | Elledge | |
| D516,639 | S | 3/2006 | Hamilton | |
| 2003/0083179 | A1 * | 5/2003 | Landfair | 482/93 |
| 2006/0003874 | A1 | 1/2006 | Hamilton | |
| 2006/0293155 | A1 | 12/2006 | Hamilton | |

OTHER PUBLICATIONS

"New Troy Interlocking Plates," advertisement appearing in Club Industry magazine Jan. 2001, undated, 1-page.

Troy, "GO-45V," obtained from http://www.usasportsinc.com/..., generated on Mar. 18, 2005, 1-page.

Troy, "GO-45V-s," obtained from http://www.usasportsinc.com/..., generated on Mar. 18, 2005, 1-page.

Troy, "5-lb Training Plate," obtained from http://www.usasportsinc.com/..., generated on Mar. 18, 2005, 1-page.http://.

Troy, "10-lb Training Plate," obtained from http://www.usasportsinc.com/..., generated on Mar. 18, 2005, 1-page.

Troy, "Bumper Plate," obtained from http://www.usasportsinc.com/..., generated on Mar. 18, 2005, 1-page.

Troy, "Wide Flanged Plate," obtained from http://www.usasportsinc.com/..., generated on Mar. 18, 2005, 1-page.

Troy, "Black Regular Plate," obtained from http://www.usasportsinc.com/..., generated on Mar. 18, 2005, 1-page.

Troy, "Rubber Encased Olympic Plate," obtained from http://www.usasportsinc.com/..., generated on Mar. 18, 2005, 1-pages.

Troy, "Gray Olympic Plate," obtained from http://www.usasportsinc.com/..., generated on Mar. 18, 2005, 1-page.

Troy, "Gray Regular Plate," obtained from http://www.usasportsinc.com/..., generated on Mar. 18, 2005, 1-page.

Troy, "Wide Flanged PO Plate," obtained from http://www.usasportsinc.com/..., generated on Mar. 18, 2005, 1-page.

Troy, "Rubber Encased-Quiet Iron Plate," obtained from http://www.usasportsinc.com/..., generated on Mar. 18, 2005, 1-page.

Troy, "Black Olympic Plate," obtained from http://www.usasportsinc.com/..., generated on Mar. 18, 2005, 1-page.

Ivanko, "Barbell Company Weightlifting Equipment Online," obtained from http://www.ivanko.com/..., generated on Mar. 18, 2005, 1-page.

Ivanko, "CBPP—Olympic Calibrated Competition Painted Powerlifting Disc—The only I.P.F. approved plate in the Western Hemisphere," obtained from http://www.ivanko.com/..., generated on Mar. 18, 2005, 2-pages.

Ivanko, "Plates," obtained from http://www.ivanko.com/..., generated on Mar. 18, 2005, 2-pages.

Ivanko, "OMC—Olympic Machined Chrome Plates," obtained from http://www.ivanko.com/..., generated on Mar. 18, 2005, 1-pages.

Ivanko, "OM—Olympic Machined Hammertone Grey Plate," obtained from http://www.ivanko.com/..., generated on Mar. 18, 2005, 2-pages.

Ivanko, "OCB—Olympic Calibrated Competition Weightlifting Disc—Finally! Quality bumper plates priced affordably," obtained from http://www.ivanko.com/..., generated on Mar. 18, 2005, 2-pages.

Ivanko, "OBP—Olympic Bumper Plate—Bumper plates for lifters on a budget!," obtained from http://www.ivanko.com/..., generated on Mar. 18, 2005, 1-page.

Ivanko, "CBP—Olympic Calibrated Competition Chrome Powerlifting Disc—The only I.P.F. approved plate in the Western Hemisphere," obtained from http://www.ivanko.com/..., generated on Mar. 18, 2005, 2-pages.

Ivanko, "O2B—Economy Black Painted Olympic Plate," obtained from http://www.ivanko.com/..., generated on Mar. 18, 2005, 2-pages.

Ivanko, "O—Olympic Non-Machined Hammertone Grey Plate," obtained from http://www.ivanko.com/..., generated on Mar. 18, 2005, 2-pages.

Ivanko, "RMC—Regular Machined Cast Iron Chrome Plate," obtained from http://www.ivanko.com/..., generated on Mar. 18, 2005, 2-pages.

Ivanko, "RUB—Standard Rubber Encased Plate," obtained from http://www.ivanko.com/..., generated on Mar. 18, 2005, 2-pages.

Ivanko, "RM—Regular Machined Grey Plate," obtained form http://www.ivanko.com..., generated on Mar. 18, 2005, 2-pages.

Ivanko, "R2B—Economy Cast Iron Black Painted Regular Plate," obtained from http://www.ivanko.com/..., generated on Mar. 18, 2005, 2-pages.

Ivanko, "R—Non-Machined Regular Machined Grey Plate," obtained from http://www.ivanko.com/..., generated on Mar. 18, 2005, 2-pages.

* cited by examiner

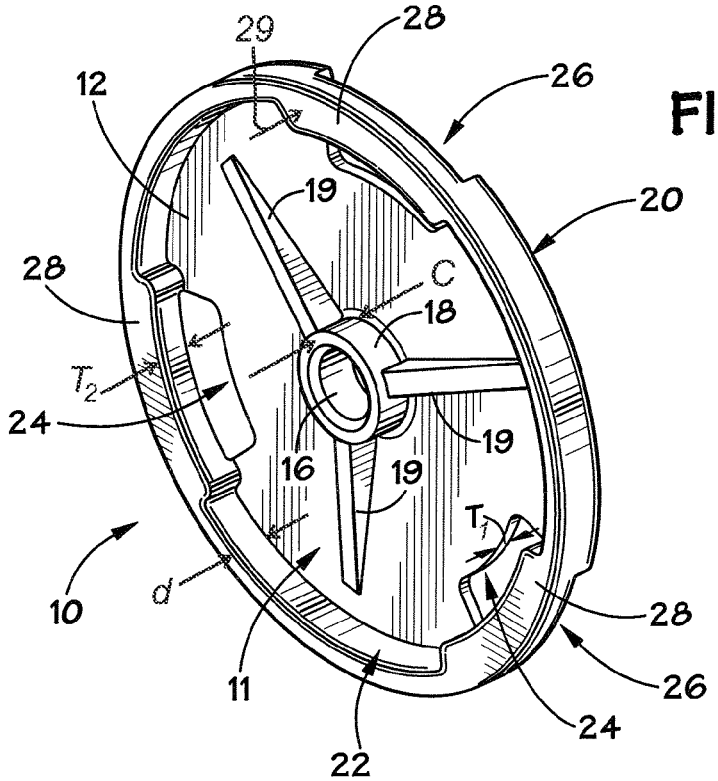
FIG. 1
FIG. 2
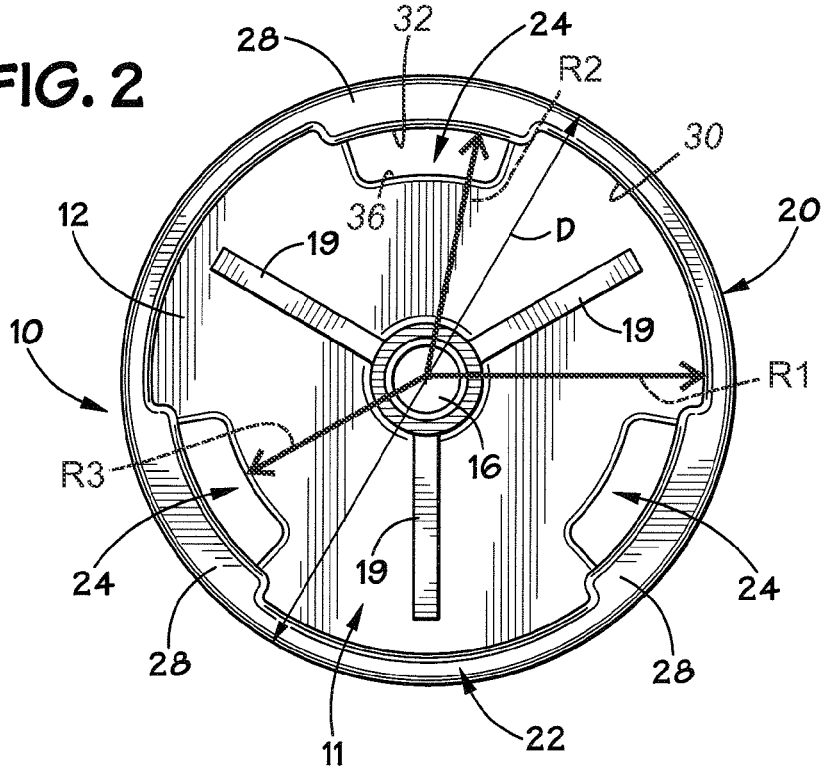

WEIGHT PLATE

BACKGROUND OF THE DISCLOSURE

The present disclosure relates generally to physical fitness equipment, and more specifically to an improved weight plate that may be used during weight lifting.

Free weight exercises generally require weight plates for use with barbells or dumbbells. The weight plates are typically disc-shaped and include a central opening for receiving a barbell or dumbbell bar through the central opening.

One major problem with free weight lifting and a cause of many accidental injuries is that it is difficult to pick up a weight plate, particularly disc-shaped plates having substantially flat sides. Most users can typically handle the lighter weights of 5 or 10 pounds without too much difficulty. But as the size and weight of the weight plate increases, one must be very careful to avoid injury. The problem, simply stated, is that a flat sided weight plate does not have a convenient hand hold to be grasped by the user for lifting it off of a flat surface, such as the floor or a stack of adjacent weight plates. Lifting a typical weight plate off of a flat surface requires that the user apply sufficient radial and frictional force on the periphery or outer perimeter of the disc-shaped plate to lift at least one side of the plate a sufficient distance off the flat surface to permit the user to place at least a portion of his fingers around the periphery and onto one side of the plate. Of course, the heavier the weight plate, the more difficult this lifting maneuver becomes. Lifting a weight plate according to the generally accepted method described above can cause injury if the weight plate slips out of the grasp of the user and falls on his or her toes or fingers.

Some weight plates include an upstanding circumferential flange about the periphery of the plate. This provides a raised surface that may be gripped by the user for lifting the weight plate. The same problems are encountered, however, when an individual attempts to lift the weight plate by its circumferential flange. A sufficient radial and frictional force must still be applied to lift the plate on its peripheral edge so that the user can grip the plate by wrapping his or her fingers and thumb about the upstanding flange and outer edge of the plate.

The problems noted above are not encountered solely when exercising with free weights. Many exercise apparatus require the weight plates be added or removed to vary the resistance provided by the exercise apparatus. The typical weight plate is not only difficult to lift off a flat surface, as noted above, but is also difficult to hold and raise up, perhaps to chest level, to mount the weight plate on an exercise apparatus. Likewise, removing a weight plate from a relatively high position on an exercise apparatus is also difficult and, if not done with care, may result in injury to the individual removing the weight plate.

Yet another constraint on the design of weight plates is control of manufacturing costs. Intricate plate designs typically cost more to manufacture than a standard weight plate, thus creating a unit cost that the market is unwilling to bear. What is needed is a simple solution to the above noted problems that also minimizes manufacturing costs. The weight plate of the present disclosure satisfies this need.

SUMMARY OF THE DISCLOSURE

A weight plate having integrally formed handles is provided. The weight plate has a weight plate body having an outer periphery, a first side, and a second side that is substantially flat. The weight plate also has a central bore extending axially through the body, a raised flange member forming a portion of the outer periphery on the first side, and at least one handle opening extending axially through the body and radially through at least a portion of the outer periphery. Each handle opening in cooperation with the raised flange member define a handle sufficient for a human hand to grip. Where multiple handle openings are employed, including two, three, and four handle openings, the handle openings are equiangularly spaced apart. Additionally, each handle opening includes edge surfaces which are rounded to improve the comfort of the user.

BRIEF DESCRIPTION OF THE DRAWINGS

A more complete understanding of the present disclosure may be obtained with reference to the accompanying drawings:

FIG. 1 is a perspective view of the first side of an illustrative embodiment of the present disclosure.

FIG. 2 is a plan view of the first side of the illustrative embodiment of the present disclosure.

DESCRIPTION OF ILLUSTRATIVE EMBODIMENTS

The present disclosure will now be described more fully with reference to the accompanying drawings in which a preferred embodiment of the disclosure is shown. This disclosure may, however, be embodied in many different forms and should not be construed as being limited to the embodiment set forth herein.

Figure 3:
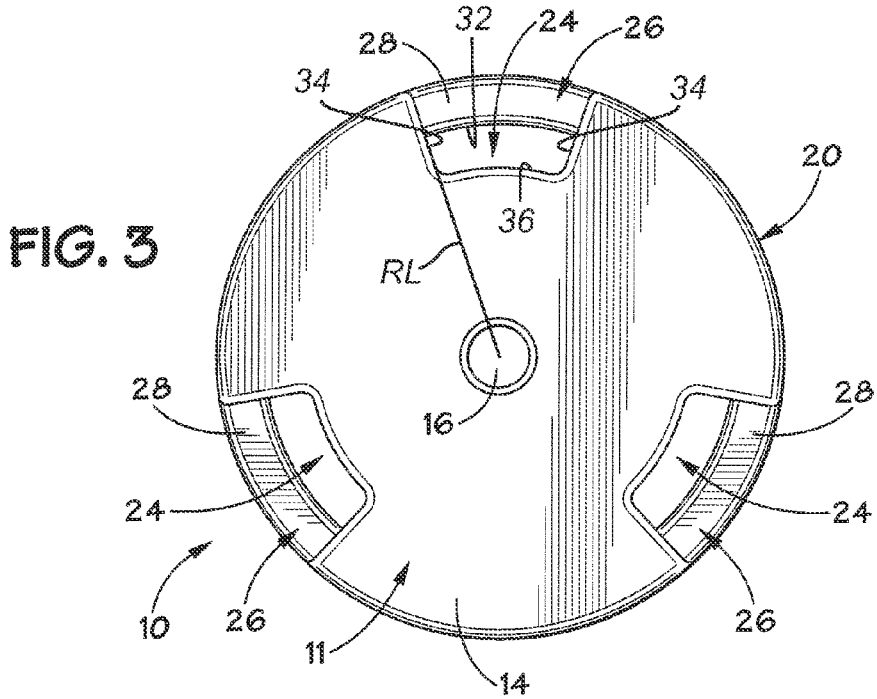
FIG. 3 is a plan view of the second side of the illustrative embodiment of the present disclosure.
Figure 5:
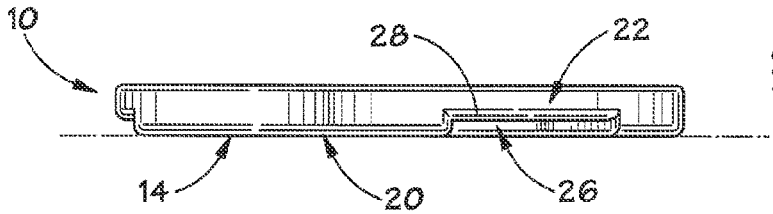
FIG. 5 is a side view of the illustrative embodiment of the present disclosure.

Referring to FIGS. 1-3, a weight plate 10 in accordance with certain teachings of the present disclosure is shown. Weight plate 10 may be cast, rubber coated, and/or polyurethane coated. Weight plate 10 has a first side 15 and a second side 17 and includes a substantially flat body 11 defined by a first planar surface 12 and a second planar surface 14. The planar surfaces 12, 14 are generally opposed and define the axial the first axial thickness $T_1$ of weight plate 10. FIGS. 1 and 2 depict the first side 15 of weight plate 10, while FIG. 3 depicts the second side 17 of weight plate 10. A centrally located bore 16 defines the rotational axis of plate 10 and is adapted to receive a mounting member (not shown), such as a barbell or a dumbbell bar. The bore 16 is further defined by an integrally formed collar 18 which projects outwardly an axial thickness C from the first planar surface 12 and adds axial length to bore 16. Support ribs 19 may also be used to provide further support for collar 18. It is understood that the diameter of bore 16 may vary to accommodate various diameter sizes of mounting members to be received through bore 16, and will generally vary between 1 to 2 inches to accommodate most standard bars.

The opposed planar surfaces 12, 14 terminate at an outer periphery 20 of plate body 11. Although FIGS. 1-3 show a substantially circular outer periphery, any periphery shape may also be used, including any polygonal-shaped. The first side 15 of weight plate 10 also includes a flange member 22 integrally formed therewith and forming a portion of the outer periphery 20 that extends outwardly an axial distance d from the first planar surface 12.

In the weight plate shown in FIGS. 1-3, weight plate 10 includes three handle openings 24 formed in the plate body 11 and extending at least partially to the outer periphery 20. Although the Figures show three handle openings 24, any number of equiangularly spaced handle openings, including but not limited to one, two, three, or four handle openings, may be used. The handle openings 24 are disposed extending through body 11 and through at least a portion of the outer periphery 20 (best illustrated in FIG. 3). Although the size of these handle openings 24 may vary depending on the size, weight, and other design particulars of a specific weight plate, each handle opening 24 should be less than about 20%, and more preferably less than about 10%, of the total area of the weight plate body plate, which is calculated as the area of each opening 24 extending through plate body 11 as a percentage of the area of the plate body 11. For clarity, the area of plate body 11 if the plate were circular as shown in FIGS. 1-3 would be simply $\pi*D^2/4$, where D is the diameter of plate body 11. For non-circular plates, the total area of the plate body 11 is would be calculated in an analogous manner.

A recess 26 having a defined third axial thickness $T_3$ shown in FIG. 3 is formed between each handle opening 24 and the adjacent raised flange member 22. Each recess 26 in conjunction with the corresponding handle opening 24 and the raised flange member 22 form a handle 28 that is dimensioned in such a way that is sufficient for a human hand to grip. As shown in FIG. 1, the handles 28 define a second axial thickness T2. For example, handle 28, opening 24, and recess 26 may be sized to receive at least a portion of one or more fingers of a human hand extending therethrough. The third axial thickness $T_3$ of recess 26 may be controlled by many means known in the art, including but not limited to increasing or decreasing the size of the flange member 22 at the locations corresponding to handle openings 24. Recess 26 may be of any axial thickness $T_3$, but is preferably less than about one inch, and more preferably less than about 0.5 inch.

Sharp edges may be eliminated by rounding edges 34 and 36 of the handle openings 24. Likewise, the raised flange member 22 may be rounded to avoid scratching or gouging the floor or harming the user in the event that the weight plate 10 is brushed against the user's body.

One of ordinary skill should appreciate that the handle 28 may be grasped in several ways, including but not limited to: (1) placing one or more fingers through recess 26 first, then wrapping the fingers about handle 28 through opening 24 while wrapping the thumb around the outer periphery 20 to secure the grip, or (2) placing one or more fingers through opening 24 first, then wrapping the fingers about handle 28 through recess 26 while wrapping the thumb around the outer periphery 20 to secure the grip.

Another aspect of the present disclosure is the substantially flat nature of second surface 14 of the plate body 10. Accordingly, manufacturing costs are reduced by providing a second surface 14 that is substantially flat and contains no integral features that would be difficult and expensive to mill. No support collar or support ribs are required as with first surface 12. No flange member is required on the second side 17 of the weight plate 10 since the handles 28 are formed using the first flange member 22 on the first side 15 of the weight plate 10.

Figure 4:
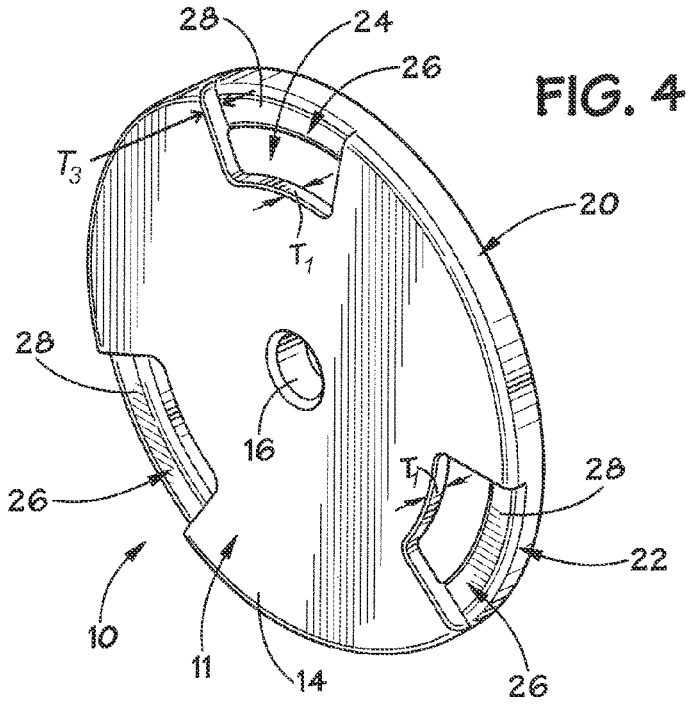
FIG. 4 is a perspective view of the second side of the illustrative embodiment of the present disclosure.

As shown in FIG. 1, the handles 22 have a distal axial limit 29. As shown in FIG. 2, the flange member 22 has a first inner face 30 with a first inner radius R1 from the center of the plate 10, while the handles 28 have a second inner face 32 with a second inner radius R2 from the center. The second inner radius R2 is less than the first inner radius R1 as shown in FIG. 2, and the first inner radius R1 of the first inner face 30 is defined concentrically about the center except for where the second inner faces 32 of the handles 28 are disposed. As shown in FIG. 2, the inner edges 36 of the openings 24 define a third radius R3 from the center less than the second inner radius R2. Finally, as shown in FIG. 4, the two side edges 34 of the openings 24 lie along a radial line RL extending from the center of the plate body 11 to the periphery 20.

It will be apparent to one of skill in the art that what is described herein is a novel weight plate having integrally formed handles. While the disclosure has been described with references to specific preferred embodiments, it is not limited to these embodiments. The disclosure may be modified or varied in many ways and such modifications and variations as would be obvious to one of skill in the art are within the scope and spirit of the disclosure and are included within the scope of the following claims.

What is claimed is:

1. A weight plate for mounting on a barbell or dumbbell bar, comprising:

a weight plate body having an outer periphery, a first side, a second side, and a first axial thickness, the first and second sides being flat;

a central bore extending axially through a center of the body;

a raised flange member forming a portion of the outer periphery on the first side and extending a distance from the first side of the body, the raised flange having a first inner face facing the center, the first inner face having a first inner radius about the center; and at least one opening extending through the body and through at least a portion of the outer periphery, wherein the raised flange member has at least one handle portion positioned across the at least one opening, wherein the first inner radius of the first inner face is defined continuously about the center except for the at least one handle portion, wherein the at least one handle portion has a second axial thickness that is less than a sum of the distance of the raised flange and the first axial thickness of the weight plate body, and wherein the at least one handle portion has a second inner face facing the center, the second inner face having a second inner radius defined continuously about the center and concentric to the first inner radius, the second inner radius being less than the first radius of the raised flange member, the at least one handle portion and the at least one opening forming at least one grippable handle on the weight plate.

2. The weight plate of claim 1, wherein the portion of the outer periphery through which each of the at least one openings extends is less than about 1 inch in axial thickness.

3. The weight plate of claim 1, wherein the weight plate body defines a total area, and wherein an area defined by each of the at least one openings is less than about 20% of the total area of the weight plate body.

4. The weight plate of claim 1, wherein the weight plate comprises a plurality of the at least one openings that are equiangularly spaced apart.

5. The weight plate of claim 1, wherein the weight plate comprises a number of the at least one openings, wherein the number of openings is selected from the group consisting of one, two, three, and four.

6. The weight plate of claim 1, further comprising:

a collar disposed about the central bore and extending a third axial thickness from the first side, the third axial thickness being less than or equal to the distance that the raised flange member extends from the first side of the body; and a plurality of support ribs extending from the first side of the body to the collar.

7. The weight plate of claim 1, wherein the at least one opening has an inner edge and two side edges in the body, the inner edge having a third radius from the center that is less than the second radius of the handle portions.

8. The weight plate of claim 7, wherein each of the two side edges lie along a radial line extending from the center to the periphery such that each of the openings is wider near the periphery.

9. The weight plate of claim 1, wherein a distal axial limit of the at least one handle portion is flush with the raised flange member.

10. The weight plate of claim 1, wherein the second axial thickness of the handle portion is less than the distance that the raised flange member extends from the weight plate body.

11. A weight plate for mounting on a barbell or dumbbell bar, comprising:

a weight plate body having an outer periphery, a first side, a second side, and a first axial thickness, the first and second sides being flat;

a central bore extending axially through a center of the body;

a raised flange member forming a portion of the outer periphery on the first side and extending a distance from the first side at the outer periphery, the raised flange member having a first inner face facing the center of the body, the first inner face having a first radius about the center;

at least one opening extending axially through the body; and a recess corresponding to each of the at least one openings and extending radially inwardly from the outer periphery through a portion of the body, the recess having a second axial thickness, whereby each of the recesses, corresponding opening, and the raised flange member form a grippable handle on the weight plate, wherein the first radius of the first inner face is defined continuously about the center except for the grippable handle portion, and wherein the grippable handle portion has a second inner face facing the center, the second inner face having a second radius defined continuously about the center and concentric to the first inner radius, the second radius being less than the first radius.

12. The weight plate of claim 11, wherein the second axial thickness of each of the recesses is less than the first axial thickness of the weight plate body.

13. The weight plate of claim 11, wherein the second axial thickness of each of the recesses is less than about 1 inch.

14. The weight plate of claim 11, wherein the weight plate comprises a plurality of the at least one openings that are equiangularly spaced apart.

15. The weight plate of claim 11, wherein the weight plate comprises a number of the at least one openings, wherein the number of openings is selected from the group consisting of one, two, three, and four.

16. The weight plate of claim 11, further comprising:

a collar disposed about the central bore and extending a third axial thickness from the first side, the third axial thickness being less than or equal to the distance that the flange member from the first side of the body; and a plurality of support ribs extending from the first side of the body to the collar.

17. The weight plate of claim 11, wherein the at least one opening has an inner edge and two side edges in the body, the inner edge having a third radius from the center that is less than the second radius of the handle portions.

18. The weight plate of claim 17, wherein each of the two side edges lie along a radial line extending from the center to the periphery such that each of the openings is wider near the periphery.

19. The weight plate of claim 11, wherein the second axial thickness of the recess is greater than the first axial thickness of the plate body.

20. A bar-mountable exercise weight, comprising:

a plate body being substantially flat and having a center, an outer periphery, a first side, and a second side, and a first axial thickness;

a bore defined axially through the center of the plate body;

a plurality of openings defined through the outer periphery of the plate body, the openings being equiangularly spaced apart; and a flange member extending a distance from the first side of the plate body and positioned about the outer periphery of the plate body, the flange member having a first inner face facing the center of the plate body, the first inner face having a first radius about the center, wherein the flange member has handle portions positioned across the openings defined through the outer periphery of the plate body, wherein the first radius of the first inner face is defined continuously about the center except for the handle portions, wherein each of the handle portions has a second inner face facing the center of the plate body, the second inner face having a second radius defined continuously about the center and concentric to the first inner radius, the second radius being less than the first radius of the flange member, each of the handle portions having a second axial thickness, wherein each of the openings and the handle portions form grippable handles on the exercise weight, and wherein the second axial thickness of the handle portions is less than a sum of the distance of the flange member and the first axial thickness of the weight plate body.

21. The exercise weight of claim 20, wherein the plurality of openings comprises three openings equiangularly spaced apart at about 120-degrees around the outer periphery of the body.

22. The exercise weight of claim 20, further comprising:

a collar disposed about the bore and extending a third axial thickness from the first side, the third axial thickness being less than or equal to the distance that the flange member extends from the first side of the body; and a plurality of support ribs extending from the first side of the body to the collar.

23. The exercise weight of claim 20, wherein each of the openings has an inner edge and two side edges in the plate body, the inner edge having a third radius from the center of the plate body that is less than the second radius of the handle portions.

24. The exercise weight of claim 23, wherein each of the two side edges lie along a radial line extending from the center of the plate body to the periphery such that each of the openings is wider near the periphery of the plate body.

25. The exercise weight of claim 20, wherein a distal axial limit of each of the handle portions is flush with the flange member.

26. The exercise weight of claim 20, wherein the second axial thickness of each of the handle portions is less than the distance of the flange member.

* * * * *